US005098076A

United States Patent [19]

Kelsey

[11] Patent Number: 5,098,076

[45] Date of Patent: Mar. 24, 1992

[54] REORDER SYSTEM FOR A BINDING LINE

[75] Inventor: Gregory C. Kelsey, Lyme, Conn.

[73] Assignee: R.R. Donnelley & Sons Company, Chicago, Ill.

[21] Appl. No.: 719,758

[22] Filed: Jun. 24, 1991

[51] Int. Cl.[5] ..... B65H 39/02

[52] U.S. Cl. ..... 270/54; 270/58; 198/347.1

[58] Field of Search ..... 270/52, 53, 54, 55, 270/56, 57, 58; 198/347.1

[56] References Cited

U.S. PATENT DOCUMENTS

| | | | |
|---|---|---|---|
| 3,608,888 | 9/1971 | McCain | 270/54 |
| 4,022,455 | 5/1977 | Newsome | 270/54 |
| 4,168,828 | 9/1979 | McLear | 270/54 |
| 5,011,123 | 4/1991 | Vigano | 270/54 |
| 5,013,022 | 5/1991 | Graushar | 270/58 |

*Primary Examiner*—Edward K. Look
*Assistant Examiner*—Therese M. Newholm
*Attorney, Agent, or Firm*—Wood, Phillips, VanSanten, Hoffman & Ertel

[57] ABSTRACT

In order to maintain mailstream sequence, even in the event of a reorder, a collating system is provided which includes a plurality of signature feeders. The signature feeders are provided for delivering a plurality of different signatures to each of a plurality of points along a conveyor to thereby form a plurality of books in the form of a stream of books carried by the conveyor. The collating system also includes an accumulator system downstream of the signature feeders having an input point for receiving each of the books from the conveyor and an output point for discharging each of the books to the conveyor in the same order it was received. A rejecting mechanism is provided for rejecting a defective one of the books from the conveyor at a point upstream of the accumulator means to thereafter cause there to be an opening in the stream of books where the defective one of the books has been rejected. The collating system further includes a reordering system for reordering the defective one of the books by selectively actuating the signature feeders to rebuild the same group of signatures upstream of the point where the defective one of the books has been rejected. With this arrangement, the collating system is such that the reordered one of the books will bypass the accumulator system in such manner as to rejoin the stream of books at the opening in the stream of books where the defective one of the books has been rejected.

25 Claims, 6 Drawing Sheets 20
26
28a
28b
28c
22a
22b
22c
POCKETS
E D C B A
24
24a
24b
24c
STITCHER
50
42
44
TRIMMER
52
MAIL HEAD
54
REORDER POINT
40
32a
32b
32c
30
34a
34b
34c
36
46
48
38
ACCUMULATOR 20
26
28a
28b
28c
22a
22b
22c
POCKETS
G F E D C B A
24
24a
24b
24c
STITCHER
50
42
44
TRIMMER
52
MAIL HEAD
54
REORDER POINT
40
32a
32b
32c
30
34a
34b
34c
36
46
48
38
ACCUMULATOR

ACCUMULATOR
REORDER POINT
MAIL HEAD
TRIMMER
STITCHER
POCKETS

ACCUMULATOR
REORDER POINT
MAIL HEAD
TRIMMER
STITCHER
POCKETS

ACCUMULATOR
REORDER POINT
MAIL HEAD
TRIMMER
STITCHER
POCKETS

ACCUMULATOR
REORDER POINT
MAIL HEAD
TRIMMER
STITCHER
POCKETS

ACCUMULATOR
REORDER POINT
MAIL HEAD
TRIMMER
STITCHER
POCKETS
20
22a
22b
22c
24
26
28a
28b
28c
30
32a
32b
32c
34a
34b
34c
36
38
40
42
44
46
48
50
52
54

ACCUMULATOR
REORDER POINT
MAIL HEAD
TRIMMER
STITCHER
POCKETS
20
22a
22b
22c
24
26
28a
28b
28c
30
32a
32b
32c
34a
34b
34c
36
38
40
42
44
46
48
50
52
54

ACCUMULATOR
REORDER POINT
MAIL HEAD
TRIMMER
STITCHER
POCKETS
20
22a
22b
22c
24
26
28a
28b
28c
30
32a
32b
32c
34a
34b
34c
36
38
40
42
44
46
48
50
52
54

ACCUMULATOR
REORDER POINT
MAIL HEAD
TRIMMER
STITCHER
POCKETS
20
22a
22b
22c
24
26
28a
28b
28c
30
32a
32b
32c
34a
34b
34c
36
38
40
42
44
46
48
50
52
54

REORDER SYSTEM FOR A BINDING LINE

FIELD OF THE INVENTION

The present invention generally relates to collating systems and, more particularly, a signature collating system for reordering defective signatures.

BACKGROUND OF THE INVENTION

One prior type of collating and binding system is disclosed in Riley et al. U.S. Pat. No. 4,121,818, which is assigned to the assignee of the instant application. This collating and binding system discloses a plurality of signature feeders disposed adjacent a conveyor, and the signature feeders are individually operated by a programmable controller so that customized or personalized books are built in accordance with information contained on a magnetic tape. In addition, means are provided along the conveyor to detect defective books which are then removed from the conveyor by a diverter that is operated by the programmable controller.

As for the above system disclosed in Riley et al., it is particularly useful for permitting customized or personalized information and/or signatures to be placed in books. Moreover, in books produced during a single production run this can be done in such a manner that each book can be customized or personalized for the person to whom it is to be sent. Additionally, these books can be collated and bound in a desired sequence for easy bundling for the purpose of taking advantage of postal discounts or to meet the requirements of the U.S. Post Office.

The assembling of customized books in a particular sequence to permit bundling according to postal regulations is difficult to achieve in an optimal fashion in the event a defective book is detected, rejected and reordered by the system. In such a case, the Riley et al. system compares the mailing information of the defective book with the mailing information of the book adjacent the first signature feeder (or the "most recent book") to determine the optimal time to reorder the book. For example, if the defective book and the most recent book have the same zip code, the defective book can be immediately reordered and grouped with other books having the same zip code to obtain postal discounts. However, if the zip code of the most recent book is different than that of the defective book, then the defective book is reordered following the last book within the same sectional center facility, or SCF, destination. As these examples illustrate, the time for reordering is determined in accordance with a comparison of the mailing information of the defective book with the mailing information of the most recent book on the conveyor.

In some cases when a book is found to be defective and is reordered, the book may no longer qualify for a certain postal discount and may instead be subject to a higher postal rate. For example, a book may be originally classified in a discount classification along with other books to be delivered to the same five-digit zip code area. However, if this book is found to be defective and is reordered at a time such that it no longer is grouped with other books of the same zip code, then this book may not qualify for the discount postage rate previously applicable. The Riley et al. system noted above is not capable of generating an indication of the change in postage, if any, caused by the reordering of the defective book.

In some cases, it may also happen that the reordering of a defective book may cause not only the reordered book to be subject to a higher postal rate but also cause the other books with which the reordered book was originally grouped to be subject to a higher postal rate as well. This may occur because the remaining books may no longer meet the minimum requirements either in terms of number or weight, for the postal discount. While the Riley et al. system noted above is not capable of generating an indication of the change in postal rate of a group of books as the result of a reordering of one or more books in the group, another type of collating and binding system has been developed for successfully achieving just such an objective.

In particular, a unique collating and binding system which includes means for deriving an indication of postage increase caused by the rejection and reordering of defective books is disclosed in Wong et al. U.S. Pat. No. 4,674,052. The Wong et al. system and patent, like the Riley et al. system and patent, has been assigned to the assignee of the instant application. While the Wong et al. system is particularly useful with collating and binding systems, it can be used in a more general sense to derive an indication of the postage required to mail any items which were gathered by a gathering system.

In this connection, the Wong et al. system includes a plurality of signature feeders which are used to deliver signatures to a plurality of stations along the collating conveyor. A computer controls the signature feeders to progressively assemble different groups of signatures on the conveyor and thereby build a series of books in an original or predetermined sequence to take advantage of postal discounts. Means are disposed along the conveyor for detecting a defective book and means responsive to the detecting means reject the defective book at a point downstream from the signature feeders.

Further, the Wong et al. system includes means for reordering the rejected book at a point in the sequence which is determined in accordance with a comparison of the postal information of the rejected book with the postal information of a book on the conveyor. This is typically the current or most recent book which is then being assembled by the system. The computer generates an indication of the incremental increase in postage for the reordered book based upon the point in the sequence at which the defective book was reordered and adds this increase to a precalculated indication of postage computed prior to collating and binding.

In Wong et al., means are included for generating an indication of the incremental increase in postage for a grouping of books which originally qualified for a postal discount but which no longer qualifies due to the reordering of one or more books in the group.

Also, Wong et al. provides means for reordering a defective book, which book originally qualified for a postal discount, at a point in the sequence which qualifies the book for another postal discount or, if this is not possible, at a point in the sequence which causes the book to be classified in the highest postal rate category.

While the Riley et al. system and the Wong et al. system both represent significant advances in the art, it will be appreciated that it would be highly desirable to be able to reorder a defective book in such a manner as to return it to its original location for inclusion in an original bundle for automatically ensuring maximal postal discounts.

The present invention is directed to overcoming one or more of the foregoing problems and achieving one or more of the resulting objectives.

SUMMARY OF THE INVENTION

It is therefore a principal object of the present invention to provide a signature collating system for reordering defective signatures. It is a further object of the present invention to provide such a signature collating system which operates in a fixed increment manner to ensure automatic attainment of maximum postal discounts. It is yet another object of the present invention to provide a signature collating system for customized book applications.

To achieve these objectives, the collating system includes means for delivering a plurality of different signatures to each of a plurality of points along a conveyor to thereby form a plurality of books at those points in the form of a stream of books carried by the conveyor. The system also includes accumulator means downstream of the delivering means having an input point for receiving each of the books from the conveyor and an output point for discharging each of the books to the conveyor at substantially the same point therealong. Means are provided for rejecting a defective one of the books from the conveyor at the point upstream of the accumulator means to thereafter cause the conveyor to have an opening where the defective one of the books has been rejected. The system further includes means for reordering the defective one of the books by selectively actuating the feeder means to rebuild the same group of signatures upstream of the point where the defective one of the books has been rejected. With this arrangement, the collating means additionally includes means for causing the reordered one of the books to bypass the accumulator means in such manner as to rejoin the stream of books at the same location where the defective one of the books has been rejected.

In a preferred embodiment, the delivering means includes a plurality of feeder means selectively actuable to deliver signatures to the conveyor to progressively build groups of signatures into the stream of books. Advantageously, the conveyor has a plurality of discrete signature-receiving spaces for receiving signatures from the feeder means to build one of the books on each of the signature-receiving spaces.

Preferably, the accumulator means receives each of the books from the next available or adjacent one of the spaces and thereafter discharges each of the books to the next available or adjacent one of the spaces. The accumulator means advantageously has a fixed number of discrete book-receiving spaces for receiving the stream of books from the conveyor at the input point in seriatim fashion, and it discharges the stream of books from the discrete book-receiving spaces to the conveyor at the output point in a first-in, first-out manner. Preferably, the accumulator means also causes the stream of books on the conveyor to be transported away from and back to the conveyor for a preselected period of time.

In an exemplary embodiment of the invention, a plurality of signature feeder boxes are selectively actuable to deliver signatures to the conveyor to progressively build groups of signatures into a book. As a result, the conveyor, which has a plurality of discrete signature-receiving spaces, can build one of the books on each of the signature-receiving spaces. Furthermore, means can be provided for controlling actuation of the signature feeder boxes to build different groups of signatures on the signature-receiving spaces into a stream of customized or personalized books In addition, the preselected period of time during which the stream of personalized books is transported away from and back to the conveyor is a time sufficient for a reordered one of the personalized books to stay on the conveyor while bypassing the accumulator means and to thereafter rejoin the stream of personalized books at the original location of the defective one of the personalized books in the stream on the conveyor. To this end, the output point of the accumulator means is preferably disposed a preselected distance downstream of the input point of the accumulator means. By providing means for causing a reordered one of the personalized books to stay on the conveyor and bypass the accumulator means, the reordered book may then rejoin the stream of personalized books at precisely the original location of the defective one of the personalized books in the stream on the conveyor in order to preserve mailing sequence and the resulting postal discount achieved thereby.

In a most highly preferred embodiment, the feeder means includes a plurality of signature feeder boxes and the actuation controlling means includes source means for actuating different combinations of signature feeder boxes. The source means establishes coded data for controlling actuation of the signature feeder boxes to build different groups of signatures in response to different coded data. The different groups of signatures each have a predetermined thickness and caliper means is provided for measuring each of the books for that predetermined thickness. The caliper means is operatively associated with the rejecting means to cause any of the books deviating from the predetermined thickness by more than a preselected amount to be rejected. The rejecting means is effective to divert books to be rejected from the conveyor to thereby create openings along the conveyor where the books to be rejected have been diverted. In addition, the reorder means is disposed intermediate the rejecting means and the accumulator means and includes means for detecting an opening along the conveyor in any of the signature-receiving spaces.

In accordance with the invention, the reordering means is effective to cause the same group of signatures to be rebuilt a fixed number of signature-receiving spaces upstream of the space of the defective one of the books. The reordering means thereby causes the defective one of the books to be reordered in a fixed increment manner relative to the accumulator means. As a result, the signature collating system is well suited for causing a reordered one of the books to be able to rejoin the stream of books at the output point of the accumulator means at the exact same opening or space in the stream of books where the defective one of the books has been diverted.

Other objects, advantages and features of the present invention will become apparent from a consideration of the following specification taken in conjunction with the accompanying drawings.

DETAILED DESCRIPTION OF THE PREFERRED EMBODIMENT

Figure 1:
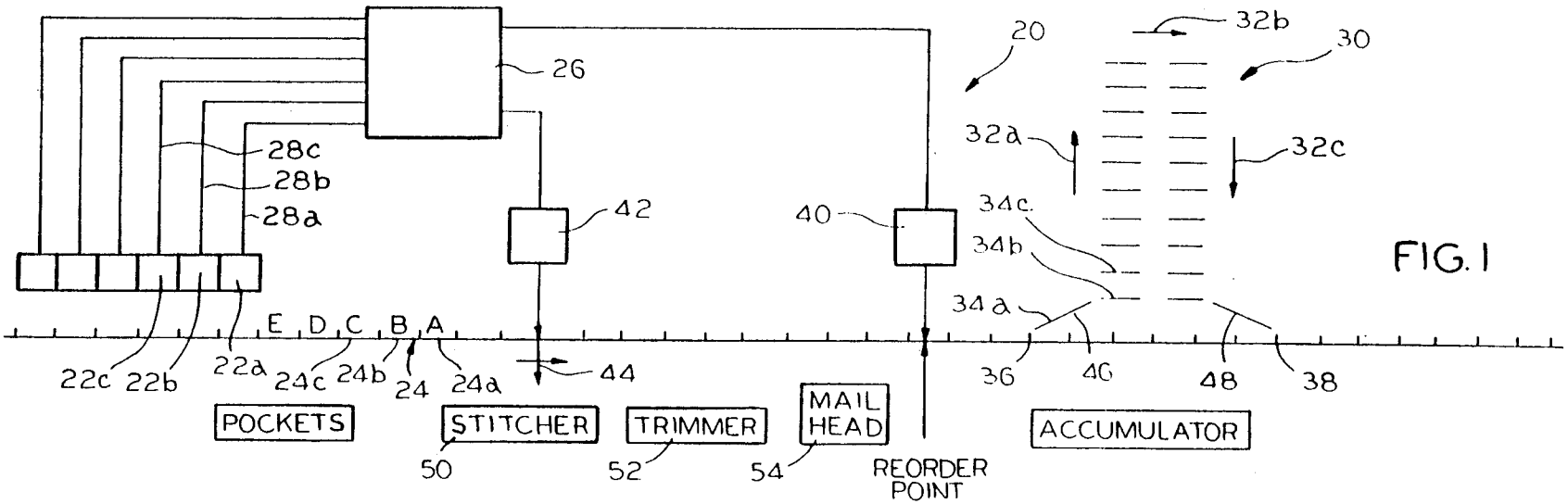
FIGS. 1 through 12 illustrate a signature collating system for reordering defective signatures in a fixed increment manner.

Referring to FIGS. 1 through 12, the reference numeral 20 designates generally a signature collating system for reordering defective signatures in a fixed increment manner. The system 20 includes a plurality of feeder means 22*a*, 22*b*, 22*c*, etc. which are selectively actuable to deliver signatures to a conveyor 24 to progressively build groups of signatures into books such as "A", "B", "C", etc. The conveyor 24 has a plurality of discrete signature-receiving spaces 24*a*, 24*b*, 24*c*, etc. for receiving signatures from the feeder means such as 22*a*, 22*b*, 22*c*, etc. to build one of the books "A", "B", "C", etc. on each of the signature-receiving spaces. The system 20 further includes means for controlling actuation of the feeder means 22*a*, 22*b*, 22*c*, etc. to build different groups of signatures on the signature-receiving spaces 24*a*, 24*b*, 24*c*, etc. into a stream of customized or personalized books such as "A", "B", "C", etc. As illustrated, the actuation controlling means may comprise a central processing unit 26 which is linked to each of the feeder means 22*a*, 22*b*, 22*c*, etc. by communication lines 28*a*, 28*b*, 28*c*, etc.

As will be seen, the system 20 also includes accumulator means 30 downstream of the feeder means 22*a*, 22*b*, 22*c*, etc. for receiving and discharging the stream of personalized books "A", "B", "C", etc. in a first-in, first-out fashion (see the arrows 32*a*, 32*b*, and 32*c* in FIG. 1). The accumulator means 30 has a fixed number of discrete book-receiving spaces 34*a*, 34*b*, 34*c*, etc. for receiving the stream of personalized books "A", "B", "C", etc. from the conveyor 24 such that each of the book-receiving spaces 34*a*, 34*b*, 34*c*, etc. receives one of the personalized books such as "A", "B", "C", etc. (if any is present) from the next available of the signature-receiving spaces such as 24*a*, 24*b*, 24*c*, etc. of the conveyor 24 in seriatim fashion when the signature-receiving spaces are positioned at an input point 36 of the accumulator means 30; each of the book-receiving spaces such as 34*a*, 34*b*, 34*c*, etc. thereafter discharges one of the personalized books such as "A", "B", "C", etc. (again, if any is present) to the next available one of the signature-receiving spaces such as 24*a*, 24*b*, 24*c*, etc. of the conveyor 24 in seriatim fashion when the signature-receiving spaces are positioned at an output point 38 of the accumulator means 30. As will be appreciated, the accumulator means 30 is thereby able to cause the stream of personalized books such as "A", "B", "C", etc. on the conveyor 24 to be transported away from and back to the conveyor 24 for a preselected period of time.

Figure 2:
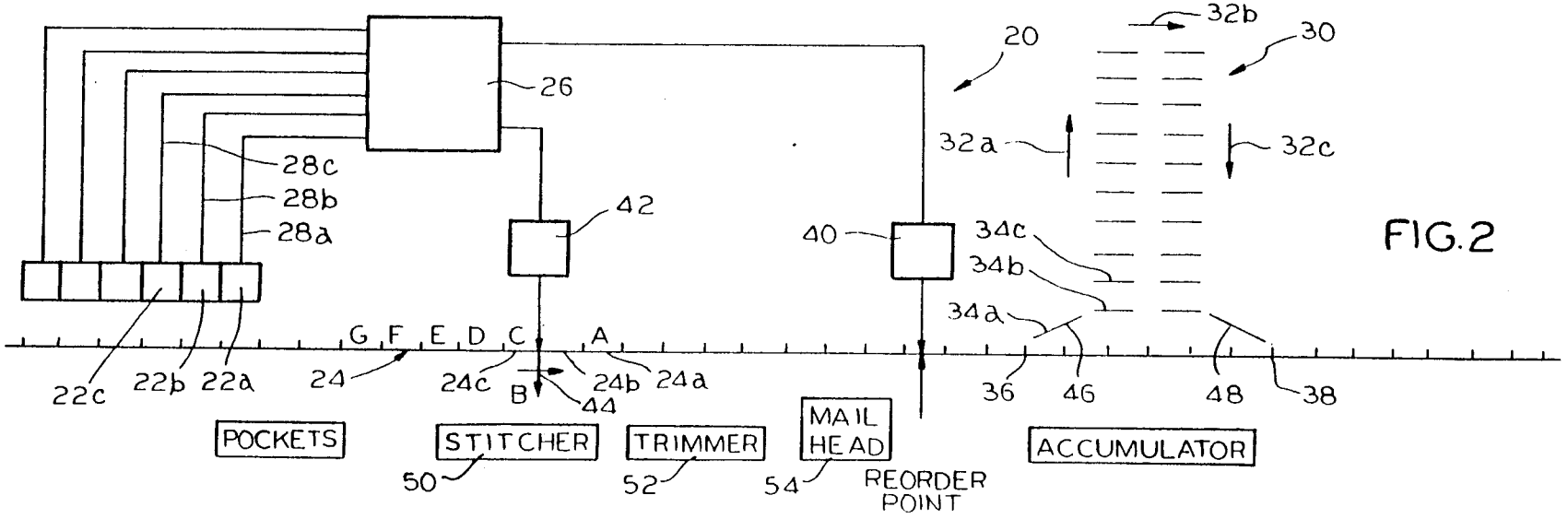
Figure 3:
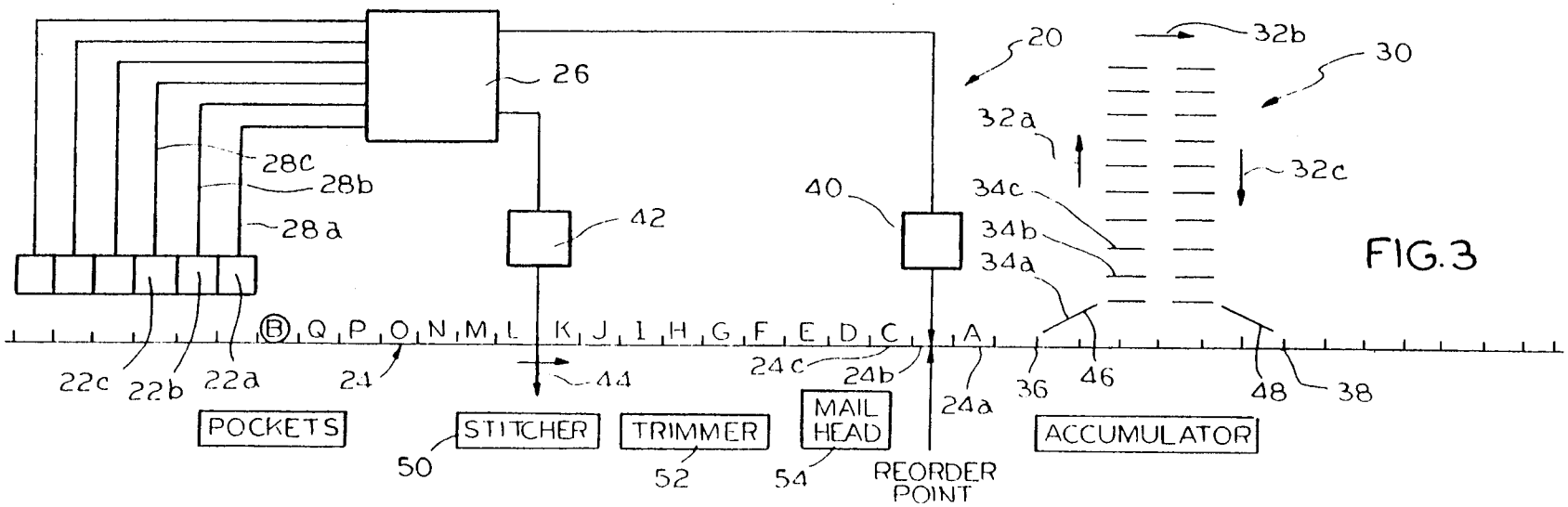

Referring to FIG. 2, the system 20 includes means for rejecting a defective one of the personalized books such as "B" from any one of the signature-receiving spaces such as 24*b* upstream of the accumulator means 30. It will also be appreciated that the system 20 includes means for reordering the defective one of the personalized books "B" by selectively actuating the feeder means 22*a*, 22*b*, 22*c*, etc. to rebuild the same group of signatures. This may be accomplished, as shown in FIG. 3, wherein an open space detector 40 is linked to the central processing unit 26 to cause the feeder means 22*a*, 22*b*, 22*c*, etc. to rebuild the same group of signatures a fixed number of signature-receiving spaces upstream of the space 24*b* of the defective one of the personalized books "B". It will, therefore, be appreciated that the system 20 thereby causes the defective one of the personalized books "B" to be reordered in what may be called a fixed increment manner relative to the accumulator means 30. Additionally, the system 20 includes means for causing the reordered one of the personalized books "B" to bypass the accumulator means 30 and rejoin the stream of personalized books "A", "C", etc. at the original location of the defective one of the personalized books "B" in the stream.

As will be appreciated, the open space detector 40 preferably constitutes an "absence detector" comprising an electronic book reorder point. This open space detector can be positioned anywhere between the feeder means 22*a*, 22*b*, 22*c*, etc. and the accumulator means 30 so long as it is at a fixed point, i.e., a fixed distance downstream of the start of the binding line. In this manner, it is possible to ensure that a reordered book rejoins the stream of books at the original location of the defective book.

As for details of the system 20, the feeder means 22*a*, 22*b*, 22*c*, etc. preferably comprise a plurality of signature feeder boxes and the central processing unit 26 preferably includes source means establishing different combinations of signature feeder boxes 22*a*, 22*b*, 22*c*, etc. to be actuated. The source means establishes coded data for controlling actuation of the signature feeder boxes 22*a*, 22*b*, 22*c*, etc. to build different groups of signatures in response to different coded data. The different groups of signatures each have a predetermined thickness such that the system 20 may include caliper means 42 for measuring each of the personalized books "A", "B", "C", etc. for the predetermined thickness. The caliper means 42 is operatively associated with the rejecting means which includes a diverter 44 for diverting books to be rejected from the conveyor 24 to thereby create openings along the conveyor 24 where the books to be rejected have been diverted. With this arrangement, the reorder means comprised of the detector 40 linked to the central processing unit 26 is disposed intermediate the rejecting means 44 and the accumulator means 30 and the detector 40 can thereby detect an opening along the conveyor 24 in any of the signature-receiving spaces such as 24*b*.

Referring once again to FIG. 1, it will be seen that the signature collating system 20 is arranged such that the output point 38 of the accumulator means 30 is disposed at a point along the conveyor 24 which is a preselected distance corresponding to a preselected number of signature-receiving spaces downstream of the input point 36 of the accumulator means 30. It will also be recalled that the accumulator means 30 causes the stream of personalized books such as "A", "C", etc. on the conveyor 24 (see FIGS. 2 through 8) to be transported away from and back to the conveyor 24 for a preselected period of time. In this connection, the preselected period of time is a time sufficient for a reordered one of the personalized books "B" to stay on the conveyor 24 while bypassing the accumulator means 30 and to thereafter rejoin the stream of personalized books "A", "C", etc. at the original location of the defective one of the personalized books "B" in the stream on the conveyor 24.

As will be appreciated, the signature collating system 20 includes bypass means in the form of bypass/direct gates 46 and 48 associated with the accumulator means 30 at the input and output points 36 and 38 to thereby permit the reordered one of the books "B" to bypass the accumulator means 30 and remain on the conveyor 24. Also, as previously mentioned, the preselected distance between the input point 36 and the output point 38 of the accumulator means 30 corresponds to a preselected number of signature-receiving spaces such as 24*a*, 24*b*, 24*c*, etc. (with the number of such spaces being six in the illustrated embodiment), and the fixed number of book-receiving spaces 34*a*, 34*b*, 34*c*, etc. of the accumulator means 30 (inclusive of a single space such as 34*a* associated with each of the bypass/direct gates 46 and 48) is then determined by the formula $BRS = SRS_{fir} + SRS_{iod}$. In this formula, $SRS_{fir}$ is the number of signature-receiving spaces such as 24*a*, 24*b*, 24*c*, etc. associated with the fixed increment reordering and $SRS_{iod}$ is the number of signature-receiving spaces such as 24*a*, 24*b*, 24*c*, etc. between the input point 36 and the output point 38.

In the illustrated embodiment, $BRS = 22$, $SRS_{fir} = 16$, and $SRS_{iod} = 6$ which can readily be determined from FIG. 3.

As also illustrated in the drawings, the system 20 will advantageously include other standard components of a binding line. These may include a stitcher 50, a trimmer 52, a mail head 54, etc. And in accordance with the invention, for any first-time reorder, the books such as "A", "B", "C", etc. will always be maintained in their original order.

In other words, the signature collating system 20 ensures that books reordered for the first time are always automatically combined with their original bundles in their original location therewithin. It will thus be seen that the system 20 is capable of dramatically reducing charges due to reorder-caused degraded mail. Still additionally, the invention makes it possible to very closely achieve nearly unanimous mail sorting by walk sequence by utilizing the concept of fixed increment reordering along with a mechanical book accumulator.

In this connection, fixed increment reordering means a defective book is only reordered at one location on a binding line. As a result, the reordered book is always a fixed number of book spaces after the original location of the rejected book.

As will also be apparent, the mechanical accumulator 30 is a device that holds the contents of a fixed number of book spaces. The accumulator 30 discharges the contents of these book spaces in a first-in, first-out fashion and also utilizes the bypass gates 46 and 48 associated with the input point 36 and the output point 38 to allow any book such as reordered book "B" to bypass the accumulator 30 and remain on the conveyor 24. Preferably, the mechanical accumulator 30 is located on the mail table just after the mail head but upstream of the walk sequence sorting equipment.

From the foregoing, it should now be seen that the intent of the accumulator 30 is to provide a slow zone before the walk sequence sorting equipment. This slow zone allows a reordered book such as "B" to catch up with its original location. As will also be appreciated, the size of the accumulator 30 is such as to have the precise number of storage spaces to match the fixed increment for reordering.

In operation, the signature collating system 20 is such that the signature feeder boxes 22*a*, 22*b*, 22*c*, etc. are selectively actuated to deliver signatures to the conveyor 24 to progressively build groups of signatures into the books "A", "B", "C", etc. (see FIG. 1). In the event of a defect detected by the caliper 42, the diverter 44 causes the defective book such as "B" on space 24*b* to be rejected (see FIG. 2). When the open space 24*b* reaches the detector 40, the book "B" is reordered by the central processing unit 26 at the beginning of the signature collating system 20 which, in the illustrated embodiment, is sixteen signature-receiving spaces away (see FIG. 3).

As will be appreciated from FIG. 3, a circled letter represents a reordered book.

Figure 4:
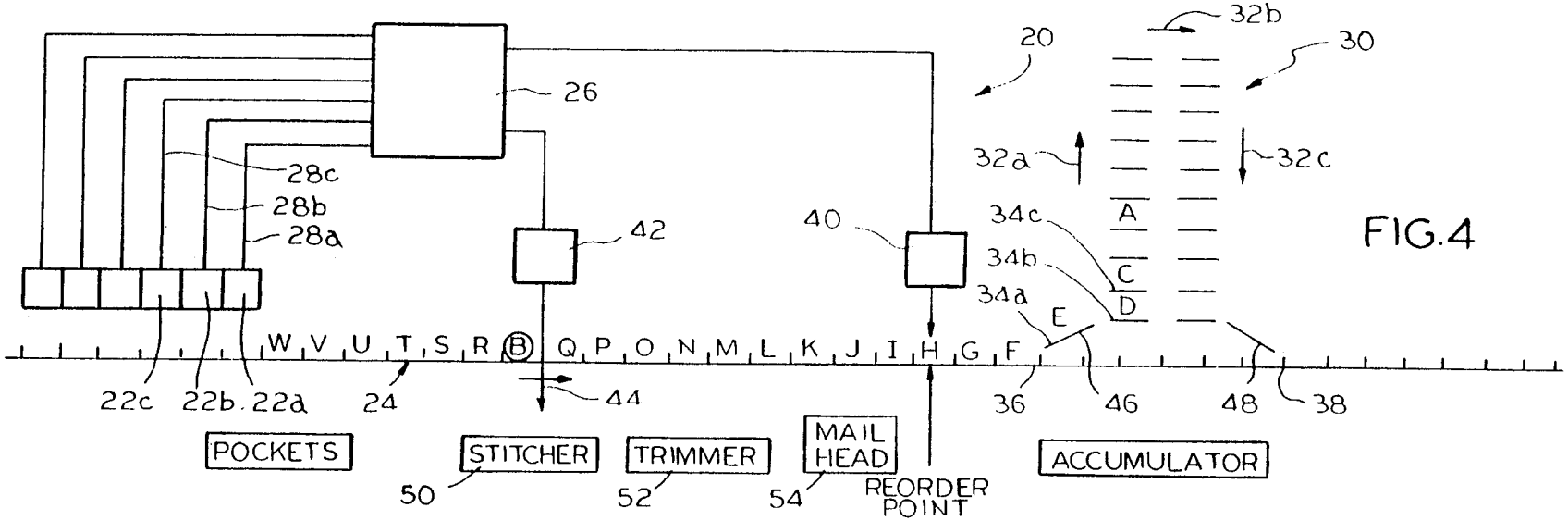

Referring to FIG. 4, it will be seen that the books "A", "C", etc. leave the conveyor 24 to travel into and through the accumulator 30. There is a space left between books "A" and "C" where original book "B" was rejected and diverted from the conveyor 24, and it will also be noted that book "K" is shown as being rejected and diverted from the conveyor 24 at a different point and possibly for a different reason by means of a bad trim detector 58. As will also be seen from FIG. 4, the production of books "R", "S", "T", etc. was delayed to allow production of reordered book "B".

Figure 5:
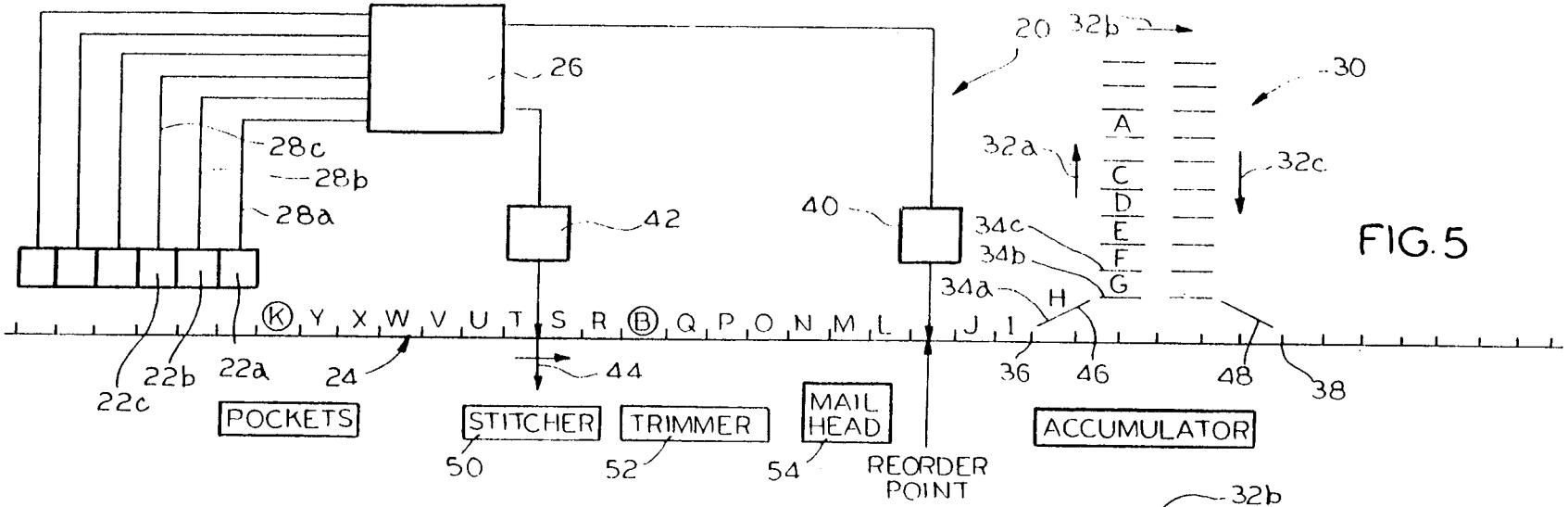
Figure 6:
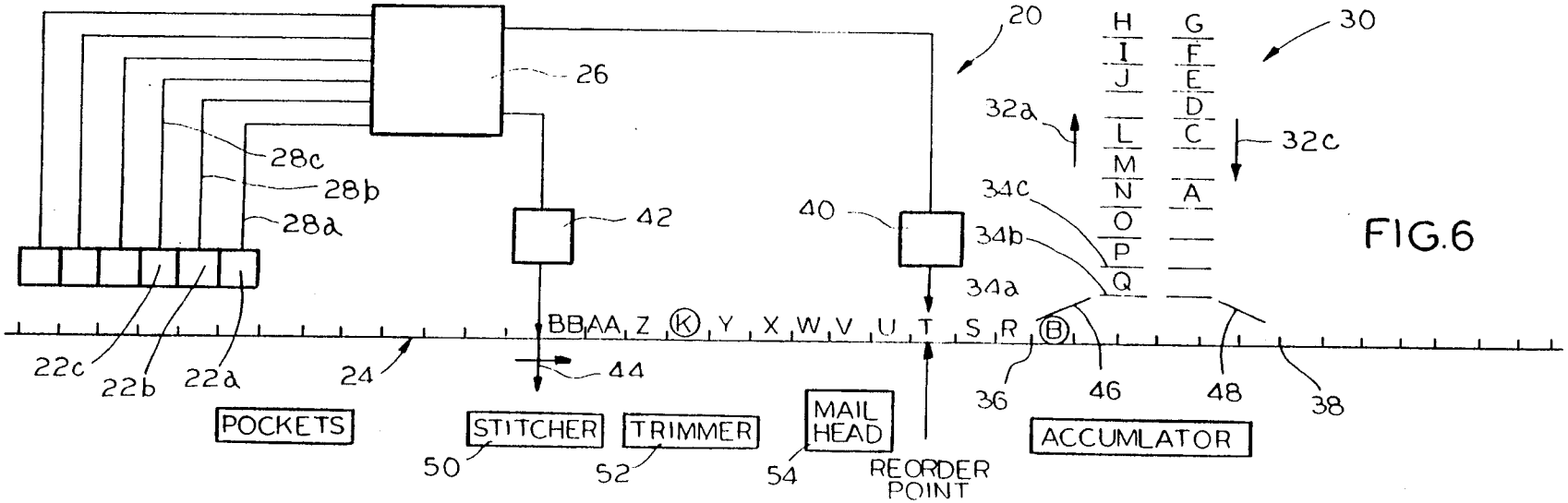
Figure 7:
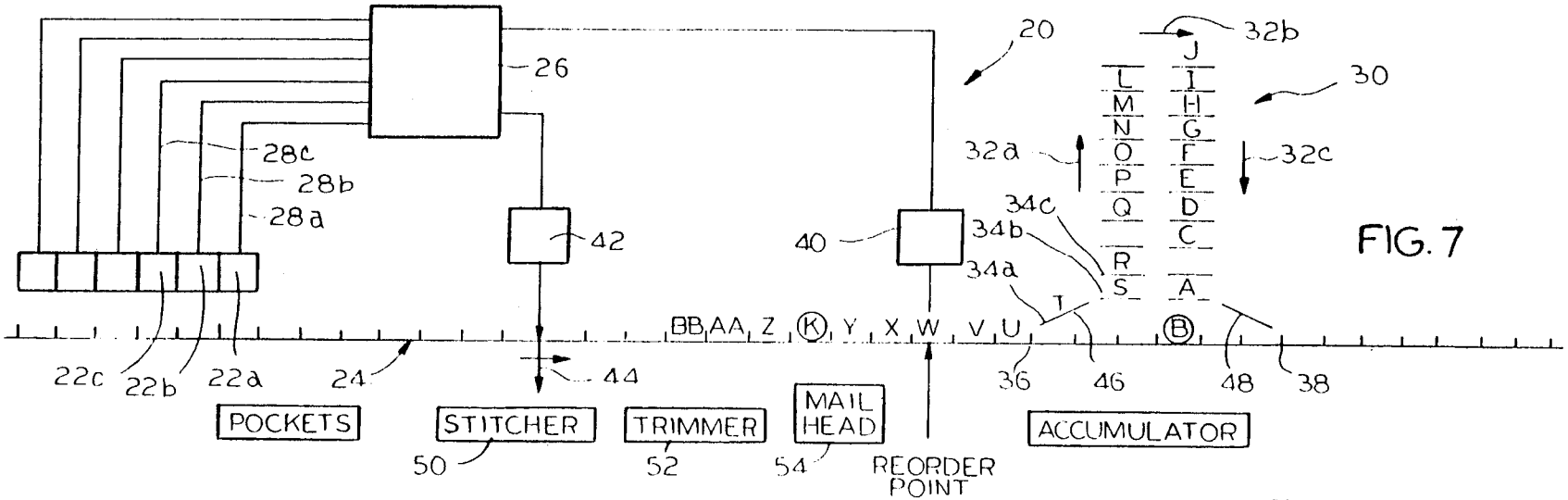
Figure 8:
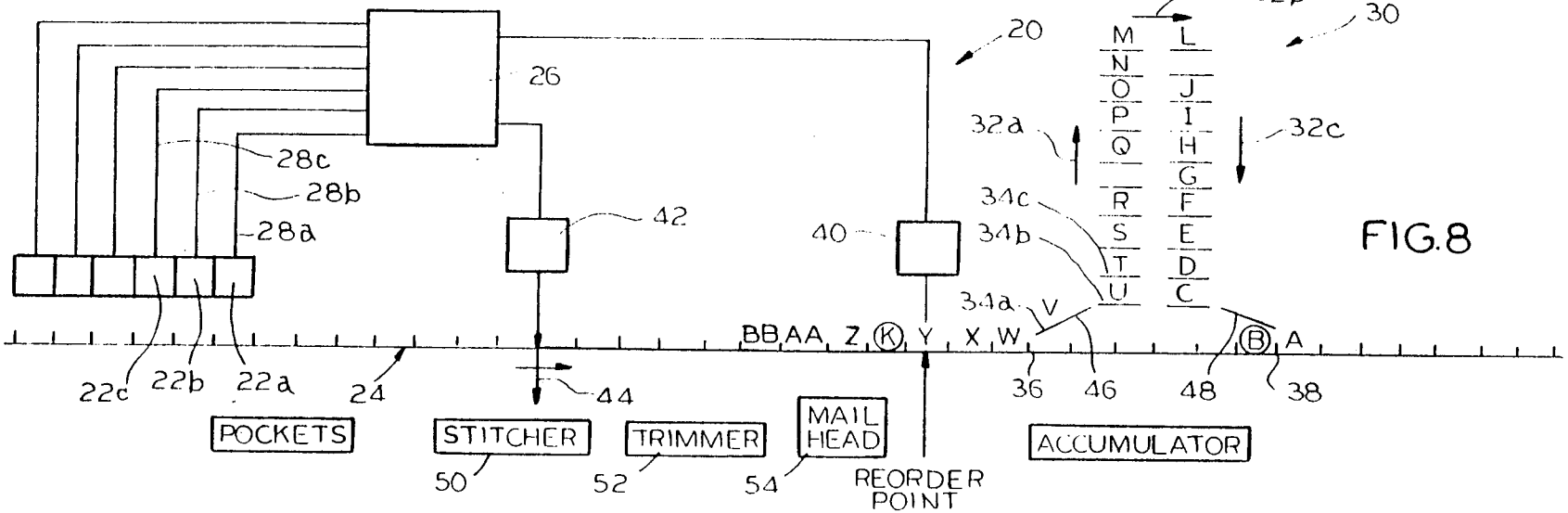

As shown in FIG. 5, book "K" has been reordered at the reorder point represented by the detector 40 and has reentered at the fixed increment position (e.g., sixteen signature-receiving spaces away). It will then be seen from FIGS. 6 and 7 that, when reordered book "B" reaches the accumulator 30, the bypass/divert gate 46 allows reordered book "B" to bypass the accumulator 30. Finally, and referring to FIG. 8, reordered book "B" catches up with the vacant space of rejected book "B" to rejoin the stream of books in the original location for book "B" in the mail stream.

Figure 9:
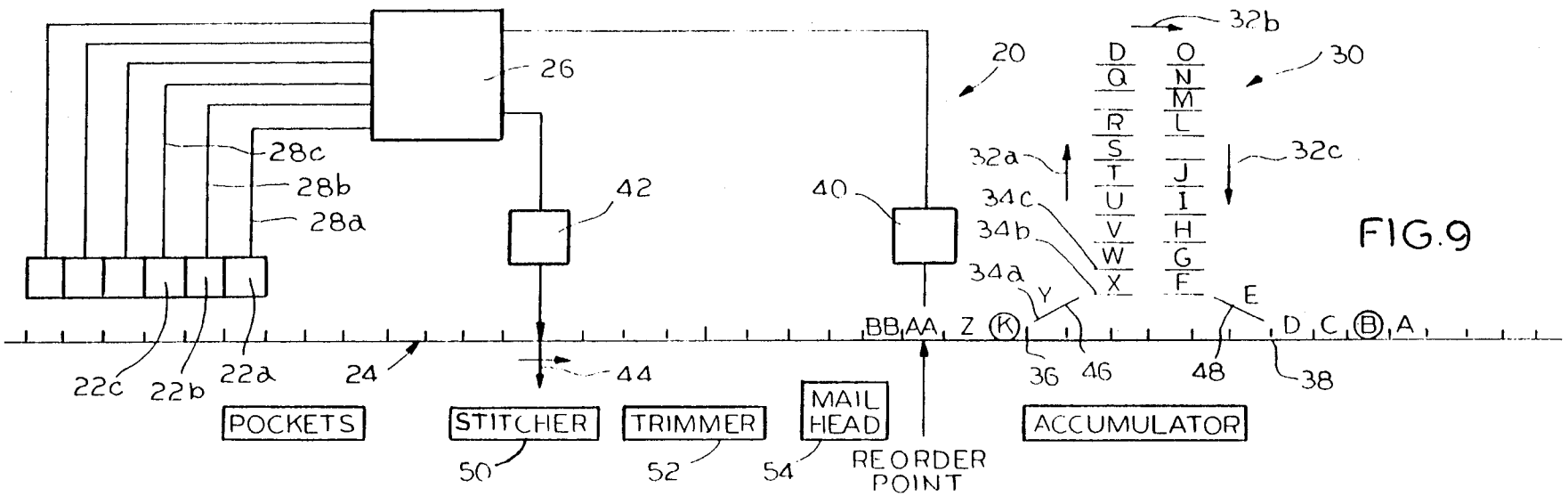
Figure 10:
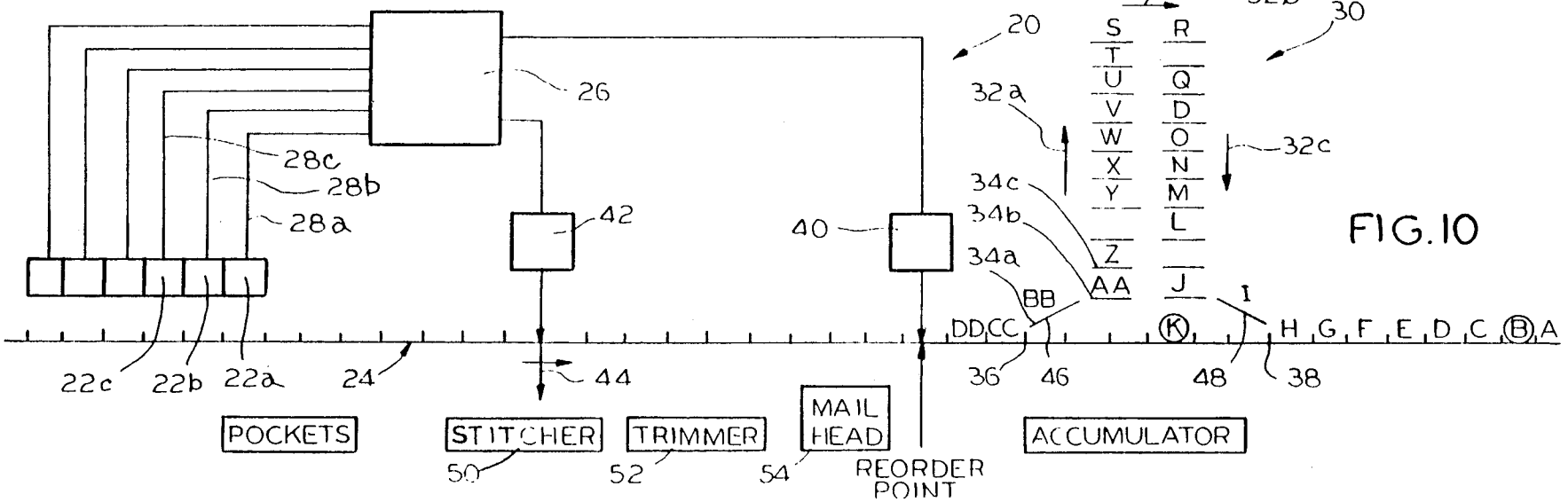
Figure 11:
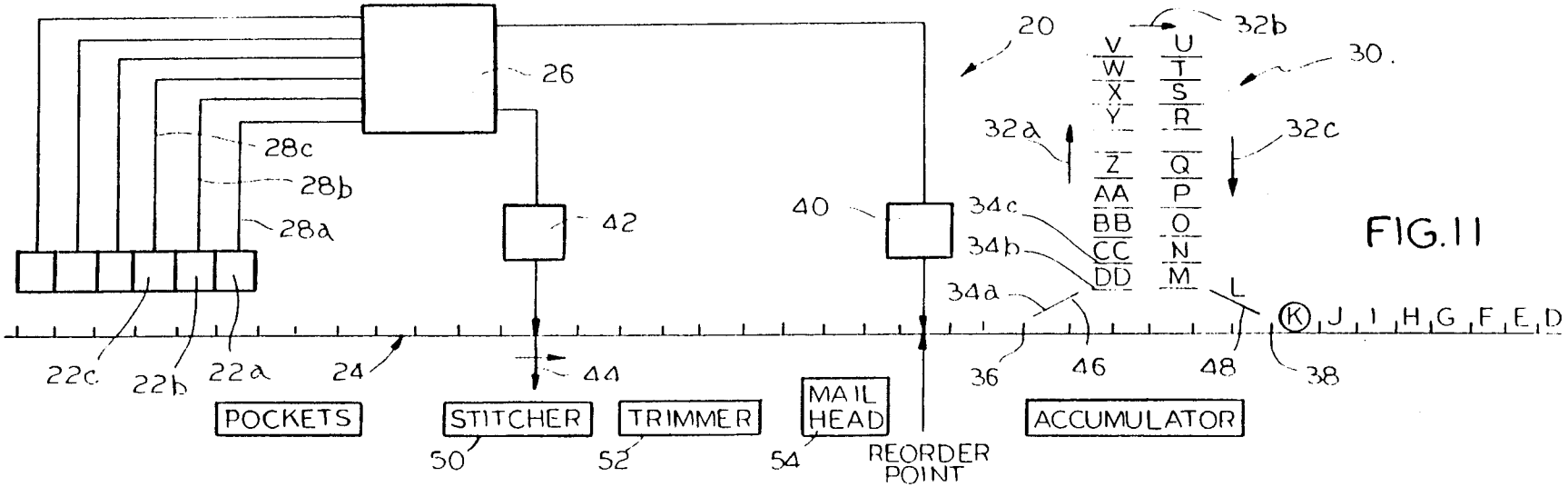
Figure 12:
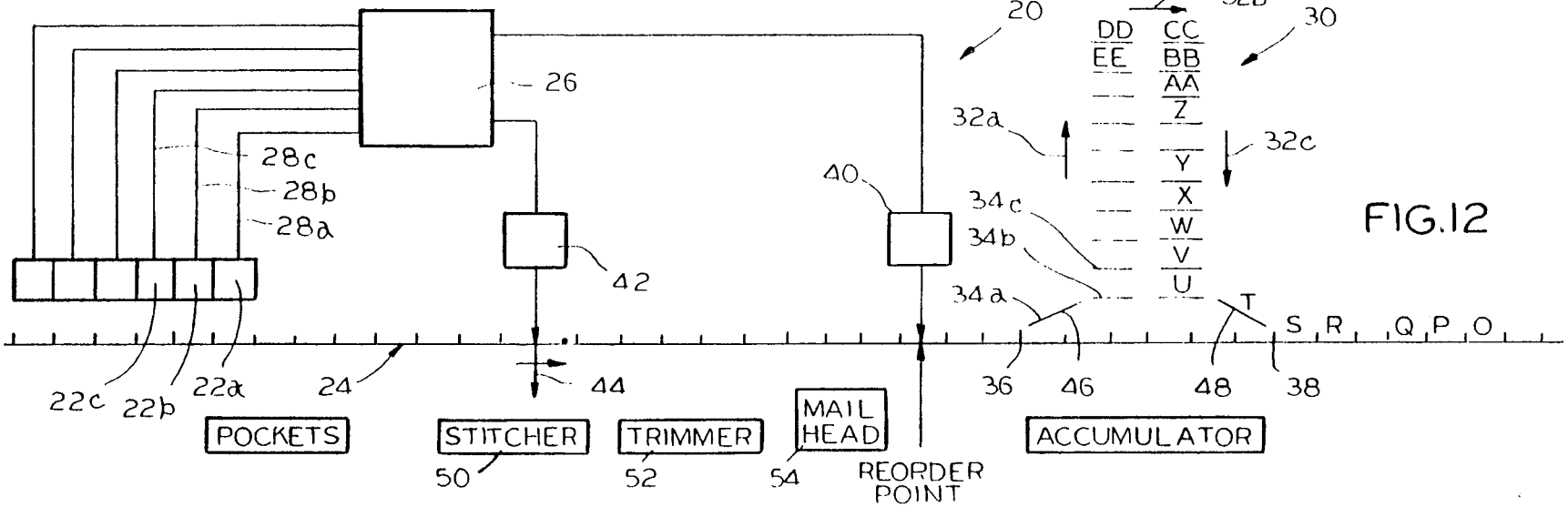

Referring to FIG. 9, it will be seen how reordered book "B" is in its proper location in the stream of books, i.e., in the original location for book "B" in the mail stream. It will also be seen that reordered book "K" is about to bypass the accumulator 30 in a fashion identical to that described in connection with reordered book "B" and, referring to FIGS. 10 and 11, the manner in which reordered book "K" bypasses accumulator 30 and recombines with the stream of books in the proper mail stream is clearly illustrated. Finally, as illustrated in FIG. 12, it will be seen that there are spaces left where reordered book "B" and reordered book "K" were produced although this causes no disruption in the mail sequence.

In accordance with the invention, the accumulator 30 comprises a simple mechanical device tied directly to the binding line drive so as to be run constantly with the binding line. The only logic selectable device associated with the accumulator 30 is the bypass/divert gate 46 at the input point 36 of the accumulator 30 which could be anything from a long serpentine lug conveyor, to an overhead conveyor, to a vertical transport with up and down sections together with a horizontal transfer at the top. Assuming one inch per book space, a horizontal transport for a 24-box, U-shaped binding line would require only about six horizontal feet and seven vertical feet of space in a plant.

While in the foregoing there has been set forth a preferred embodiment of the invention, it will be appreciated that the details herein given may be varied by those skilled in the art without departing from the true spirit and scope of the appended claims.

I claim:

1. A collating system, comprising:

means for delivering a plurality of different signatures to each of a plurality of points along a conveyor, said delivering means thereby forming a plurality of books at said points in the form of a stream of books carried by said conveyor;

accumulator means downstream of said delivering means having an input point for receiving each of said books from said conveyor and an output point for discharging each of said books to said conveyor at substantially the same point therealong;

means for rejecting a defective one of said books from said conveyor at a point upstream of said accumulator means to thereafter cause said conveyor to have an opening where said defective one of said books has been rejected;

means for reordering said defective one of said books by selectively actuating said feeder means to rebuild the same group of signatures upstream of said point where said defective one of said books has been rejected; and means for causing said reordered one of said books to by-pass said accumulator means in such manner as to rejoin said stream of books at said point opening along said conveyor where said defective one of said books has been rejected.

2. The collating system of claim 1 wherein said delivering means includes a plurality of feeder means selectively actuable to deliver signatures to said conveyor to progressively build groups of signatures into said stream of books.

3. The collating system of claim 1 wherein said conveyor has a plurality of discrete signature-receiving spaces for receiving signatures from said delivering means to build one of said books on each of said signature-receiving spaces.

4. The collating system of claim 3 wherein said accumulator means receives each of said books from one of said signature-receiving spaces and thereafter discharges each of said books to one of said signature-receiving spaces.

5. The collating system of claim 1 wherein said accumulator means has a fixed number of discrete book-receiving spaces for receiving said stream of books from said conveyor at said input point in seriatim fashion.

6. The collating system of claim 5 wherein said accumulator means discharges said stream of books from said discrete book-receiving spaces to said conveyor at said output point in a first-in first-out manner.

7. The collating system of claim 1 wherein said accumulator means causes said stream of books on said conveyor to be transported away from and back to said conveyor for a preselected period of time.

8. A signature collating system for reordering defective signatures, comprising:

a plurality of feeder means selectively actuable to deliver signatures to a conveyor having a plurality of discrete signature-receiving spaces to progressively build groups of signatures on each of said spaces into a stream of books;

accumulator means downstream of said feeder means for receiving said each of books from a next available one of said spaces on said conveyor and thereafter discharging each of said books to a next available one of said spaces on said conveyor;

means for rejecting a defective one of said books from an original location in said stream of books upstream of said accumulator means to thereafter cause said original location in said stream of books to be an open space;

means for reordering said defective one of said books by selectively actuating said feeder means to rebuild the same group of signatures, said feeder means causing the same group of signatures to be rebuilt a fixed number of signature-receiving spaces upstream of said original location of said defective one of said books in said stream of books. said reordering means thereby causing said defective one of said books to be reordered in a fixed increment manner relative to said accumulator means; and means for causing said reordered one of said books to by-pass said accumulator means in order to rejoin said stream of books on said conveyor at said original location of said defective one of said books in said stream of books.

9. The signature collating system of claim 8 wherein said conveyor has a plurality of discrete signature-receiving spaces for receiving signatures from said feeder means to build one of said books on each of said signature-receiving spaces.

10. The signature collating system of claim 8 including means for controlling actuation of said feeder means to build different groups of signatures on said signature-receiving spaces such that said stream of books on said conveyor is personalized.

11. The signature collating system of claim 8 wherein said accumulator means has a fixed number of discrete book-receiving spaces for receiving said stream of books from said conveyor at an input point in seriatim fashion.

12. The signature collating system of claim 8 wherein said accumulator means discharges said stream of books from said discrete book-receiving spaces to said conveyor at an output point in a first-in first-out manner.

13. The signature collating system of claim 8 wherein said accumulator means causes said stream of books on said conveyor to be transported away from and back to said conveyor for a preselected time period.

14. The signature collating system of claim 13 wherein said preselected time period permits said reordered one of said books to rejoin said stream of books on said conveyor at said open space in said stream of books.

15. A signature collating system for reordering signatures in a fixed increment manner, comprising:

a plurality of feeder means selectively actuable to deliver signatures to a conveyor to progressively build groups of signatures into a book, said conveyor having a plurality of discrete signature-receiving spaces for receiving signatures from said feeder means to build one of said books on each said of signature-receiving spaces, and means for controlling actuation of said feeder means to build different groups of signatures on said signature-receiving spaces into a stream of personalized books;

accumulator means downstream of said feeder means for receiving and discharging said stream of personalized books in a first-in, first-out fashion;

means for rejecting a defective one of said personalized books from an original location in said stream of personalized books at a point upstream of said accumulator means;

said accumulator means having a fixed number of discrete book-receiving spaces for receiving said stream of personalized books from said conveyor, each of said book-receiving spaces receiving one of said personalized books, if any, from the next available of said signature-receiving spaces of said conveyor in seriatim fashion when said signature-receiving spaces are positioned at an input point of said accumulator means and each of said book-receiving spaces thereafter discharging one of said personalized books, if any, to the next available of said signature-receiving spaces of said conveyor in seriatim fashion when said signature-receiving spaces are positioned at an output point of said accumulator means, said accumulator means causing said stream of personalized books on said conveyor to be transported away from and back to said conveyor for a preselected period of time;

means for reordering said defective one of said personalized books by selectively actuating said feeder means to rebuild the same group of signatures, said feeder means causing the same group of signatures to be rebuilt a fixed number of signature-receiving spaces upstream of said space of said defective one of said personalized books, said reordering means thereby causing said defective one of said personalized books to be reordered in a fixed increment manner relative to said accumulator means; and means for causing said reordered one of said personalized books to by-pass said accumulator means and rejoin said stream of personalized books, said preselected period of time being a time sufficient for said reordered one of said books to rejoin said stream of personalized books on said conveyor at said original location of said defective one of said books in said stream of personalized books, whereby said books may be mail sorted downstream of said accumulator means to maximize postal discounts for original and reordered books.

16. The signature collating system of claim 15 wherein said feeder means include a plurality of signature feeder boxes and said actuation controlling means includes source means establishing different combinations of signature feeder boxes to be actuated.

17. The signature collating system of claim 16 wherein said source means establishes coded data for controlling actuation of said signature feeder boxes to build different groups of signatures in response to different coded data.

18. The signature collating system of claim 17 wherein said different groups of signatures each have a predetermined thickness and including caliper means for measuring each of said personalized books for said predetermined thickness.

19. The signature collating system of claim 18 wherein said caliper means is operatively associated with said rejecting means to cause any of said books deviating from said predetermined thickness by more than a preselected amount to be rejected.

20. The signature collating system of claim 19 wherein said rejecting means also diverts books to be rejected from said conveyor to thereby create openings along said conveyor where said books to be rejected have been diverted.

21. The signature collating system of claim 20 wherein said reorder means is disposed intermediate said rejecting means and accumulator means and includes means for detecting an opening along said conveyor in any of said signature-receiving spaces.

22. A signature collating system for reordering signatures in a fixed increment manner, comprising:

a plurality of signature feeder boxes selectively actuable to deliver signatures to a conveyor to progressively build groups of signatures into a book, said conveyor having a plurality of discrete signature-receiving spaces for receiving signatures from said signature feeder boxes to build one of said books on each said of signature-receiving spaces, and means for controlling actuation of said signature feeder boxes to build different groups of signatures on said signature-receiving spaces into a stream of personalized books;

accumulator means downstream of said signature feeder boxes for receiving and discharging said stream of personalized books in a first-in, first-out fashion;

means for rejecting a defective one of said personalized books from an original location in said stream of personalized books at a point upstream of said accumulator means, said rejecting means also diverting books to be rejected from said conveyor to thereby create openings along said conveyor where said books to be rejected have been diverted;

said accumulator means having a fixed number of discrete book-receiving spaces for receiving said stream of personalized books from said conveyor, each of said book-receiving spaces receiving one of said personalized books, if any, from the next available of said signature-receiving spaces of said conveyor in seriatim fashion when said signature-receiving spaces are positioned at an input point of said accumulator means and each of said book-receiving spaces thereafter discharging one of said personalized books, if any, to the next available of said signature-receiving spaces of said conveyor in seriatim fashion when said signature-receiving spaces are positioned at an output point of said accumulator means, said accumulator means causing said stream of personalized books on said conveyor to be transported away from and back to said conveyor for a preselected time period;

said output point of said accumulator means being disposed a preselected distance downstream of said input point of said accumulator means;

means for reordering said defective one of said personalized books by selectively actuating said signature feeder boxes to rebuild the same group of signatures, said signature feeder boxes causing the same group of signatures to be rebuilt a fixed number of signature-receiving spaces upstream of said space of said defective one of said personalized books, said reordering means thereby causing said defective one of said personalized books to be reordered in a fixed increment manner relative to said accumulator means; and means for causing said reordered one of said personalized books to by-pass said accumulator means and rejoin said stream of personalized books, said preselected period of time and said preselected distance being a time and distance sufficient for said reordered one of said books to rejoin said stream of personalized books on said conveyor at said original location of said defective one of said books in said stream of personalized books, whereby said books may be mail sorted downstream of said accumulator means to maximize postal discounts for original and reordered books.

23. The signature collating system of claim 22 wherein said by-pass means comprises a by-pass/direct gate associated with said accumulator means at both of said input and output points to permit said reordered one of said books to remain on said conveyor.

24. The signature collating system of claim 23 wherein said preselected distance between said input point and said output point of said accumulator means corresponds to a preselected number of signature-receiving spaces on said conveyor.

25. The signature collating system of claim 24 wherein said fixed number of book-receiving spaces of said accumulator means inclusive of a single space associated with each of said by-pass/direct gates is determined by the formula $$BRS = SRS/FIR - SRS/IOD$$

where SRS/FIR is the number of signature-receiving spaces associated with said fixed increment reordering, SRS/IOD is the number of signature-receiving spaces associated with said input—output distance, and BRS is the number of book-receiving spaces.

* * * * *